United States Patent [19]

Vandenbroucke et al.

[11] Patent Number: 5,046,534

[45] Date of Patent: Sep. 10, 1991

[54] WEAVING MACHINE WITH MAIN SHAFT LOCK

[75] Inventors: André Vandenbroucke, Langemark; Johny Grimmonprez, Ieper; Walter Bilcke, Geluveld-Zonnebeke, all of Belgium

[73] Assignee: Picanol N.V., naamloze vennootschap, Belgium

[21] Appl. No.: 545,825

[22] Filed: Jun. 29, 1990

[30] Foreign Application Priority Data

Jun. 29, 1989 [BE] Belgium ..... 8900716

[51] Int. Cl.[5] ..... D03D 51/00

[52] U.S. Cl. ..... 139/336; 139/1 E; 188/69

[58] Field of Search ..... 139/1 E, 336; 192/114 R, 4 A; 70/183, 182, 187, 190; 188/69, 163, 82.7, 82.74

[56] References Cited

U.S. PATENT DOCUMENTS

| | | | |
|---|---|---|---|
| 2,707,977 | 5/1955 | Sanderson | 139/336 |
| 4,386,683 | 6/1983 | Schmitz | 139/336 |
| 4,576,261 | 3/1986 | Barr | 192/4 A |
| 4,592,392 | 6/1986 | Vandeweghe et al. . | |
| 4,637,437 | 1/1987 | Greger | 139/336 |

FOREIGN PATENT DOCUMENTS 2706646 8/1978 Fed. Rep. of Germany .

*Primary Examiner*—Andrew M. Falik
*Attorney, Agent, or Firm*—Bacon & Thomas

[57] ABSTRACT

A weaving machine of the type in which a main shaft is braked by an electromagnetic brake has, in addition to the brake, a lock for locking the main shaft against rotation. The lock includes a locking element which meshes into gear teeth of a wheel coupled to the main shaft. The lock is automatically activated when power to the weaving machine fails, and may be deactivated by turning a hand wheel.

17 Claims, 6 Drawing Sheets

WEAVING MACHINE WITH MAIN SHAFT LOCK

BACKGROUND OF THE INVENTION

This invention concerns a weaving machine, in particular a weaving machine with a lock.

It is known for weaving machines that the harness motion can be obtained by means of a positive or negative drive. A negative drive moves the harness frames in one direction through cams, and in the other direction through springs which ensure the contact with the cams. The harness drive is coupled to the main shaft of the weaving machine.

It is also known that the main shaft of the weaving machine can be equipped with an electromagnetic brake, which is activated by electric energization. When the weaving machine stops, this brake is energized. In the case of weaving machines with a negative harness drive, it is clear that the brake must also receive a couple at standstill, namely the couple exercised by the springs of the harness frames on the harness drive and therefore also on the main shaft. The intensity and direction of this couple depend of course on the position of the main shaft and the position of the various harnesses.

If in such a weaving machine a voltage failure occurs in the power supply of the electromagnetic brake, the brake couple is eliminated and the harness frames are moved by the above-mentioned springs until a state of equilibrium has been reached. The main shaft and the sley are hereby also moved. It is clear that this is very dangerous for a weaver working on the weaving machine, particularly when pulling a new warp thread through the reed and through the harnesses, when repairing a weft thread in the shed and when regulating the gripper course on gripper weaving machines.

In order to reduce the above-mentioned risk, said weaving machines are usually equipped with capacitors which ensure the energization of the electromagnetic brake for a period of time after the mains voltage has failed. This period is usually insufficient to do normal repair work on a weft thread or warp thread.

For other repair work which can take a long time, such as the maintenance of the weaving machine, the brake is previously uncoupled, so that a state of equilibrium is reached. The disadvantage is, however, that at the start of the weaving machine, the various weaving machine parts are not any longer in their optimum position to avoid starting marks and the like.

According to another possibility, in case of longer standstills of the weaving machine the springs of the harness frames can be uncoupled. However, this is a relatively cumbersome job.

According to another known possibility, an electromagnetic brake is used, whereby the brake force is obtained under the influence of a spring force, and whereby the deactivation of this brake is done by energizing the electromagnet, such that the brake is opened against the spring force. This brake has the disadvantage that a large amount of energy is required during the normal operation of the weaving machine. Such a brake also has the disadvantage that, during a standstill, the weaving machine is entirely blocked and that a rotation by means of the hand wheel is no longer possible, unless a special device is provided with the aim of deactivating this brake manually.

Apparently, the above-mentioned problem occurs less frequently on weaving machines with a positive harness drive. In such a positive harness drive, the movement of the harness frames in both directions is exclusively obtained by means of cam guides. When the weaving machine stops, a considerable couple may occur when the largest number of harnesses are in their highest position, while only a few harness frames are in their lowest position. Indeed, in that case it is possible that the weaving machine is set in motion due to the weight of the lifted harness frames or due to the tension in the warp threads.

However, the above-mentioned problem can also occur in other cases than with a negative harness drive, for instance on weaving machines whereby the sley or another weaving machine part is charged by the springs in its retired position.

SUMMARY OF THE INVENTION

The present invention concerns a weaving machine, which solves the above-mentioned problem without the above-mentioned disadvantages of the known devices.

For this purpose, the invention concerns a weaving machine of the type whereby the main shaft is provided with an electromagnetic brake which is activated by means of electric energization, characterized in that the weaving machine has, apart from the above-mentioned brake, a lock with which the main shaft can be directly or indirectly locked against rotation, and which includes of a locking element which can mesh into a wheel which is coupled to the main shaft and which is equipped with gear teeth.

According to a preferred embodiment, the weaving machine also has means which automatically activate the lock when the main voltage of the weaving machine fails.

According to a variant, the weaving machine according to the invention also has a hand wheel as well as means which allow the above-mentioned lock to be deactivated when this hand wheel is operated.

BRIEF DESCRIPTION OF THE DRAWINGS

In order to better explain the characteristics of the invention, by way of example only and without being limitative in any way, the following preferred embodiments are described with reference to the accompanying drawings, where.

DETAILED DESCRIPTION OF THE PREFERRED EMBODIMENTS

Figure 1:
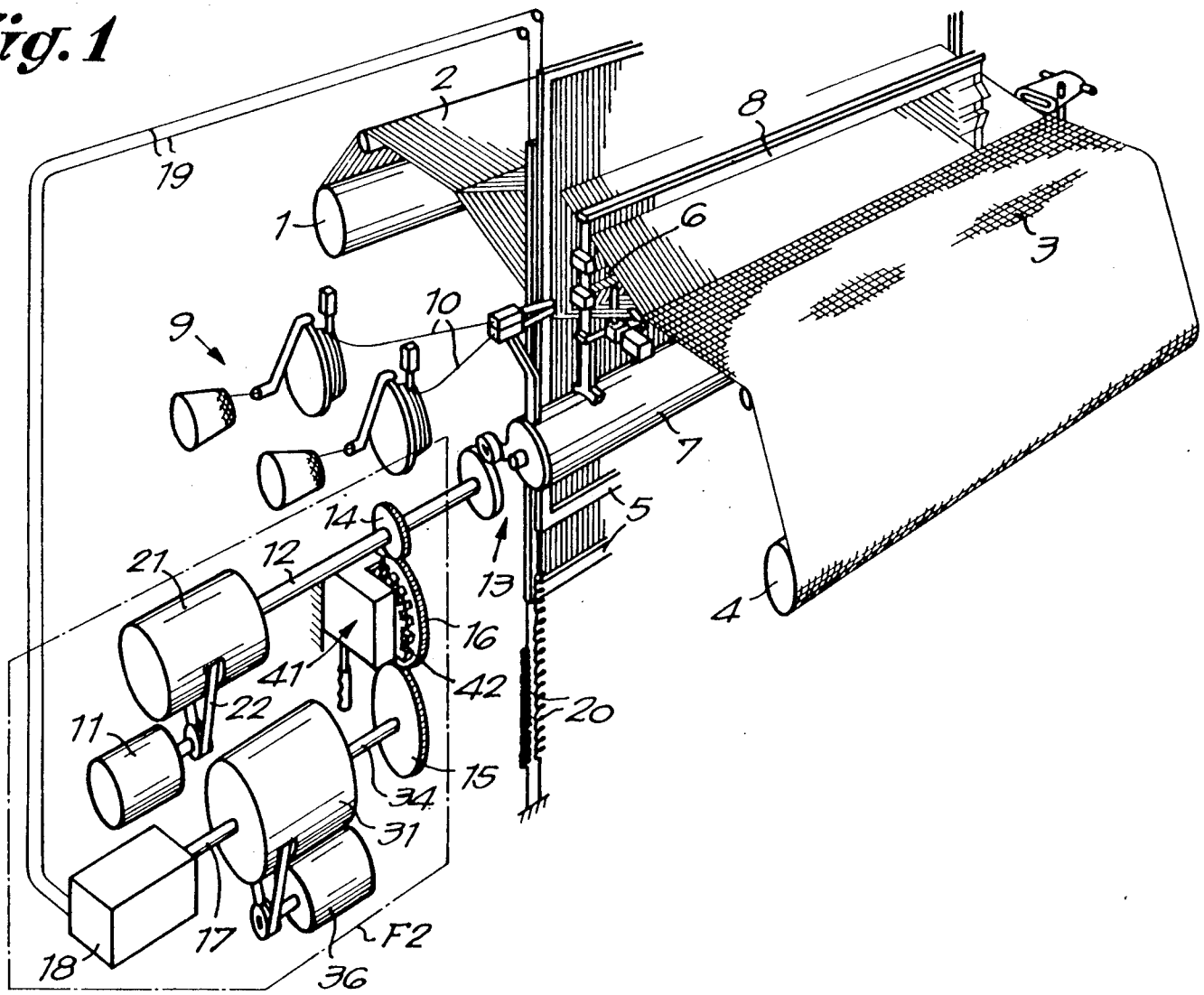
FIG. 1 shows a schematic representation of a weaving machine according to the invention.

By way of illustration, FIG. 1 shows a schematic representation of a weaving machine, with as its main parts the warp beam 1 the warp 2, the formed cloth 3, the cloth beam 4, the harness frames 5, the shed 6 formed by the harness frames, the sley 7 with the reed 8 and supply means 9 for the supply of weft threads 10. The drive of the weaving machine is by means of the main drive motor 11 which can be coupled to the main shaft 12, which in turn provides the movement of the sley 7 by means of the cam drive 13. The main shaft 12 is, for example by means of gears 14 and 15 and an intermediate gear 16, coupled to the drive shaft 17 of the harness drive mechanism 18, which has a known cam mechanism, of which the movement is transferred to the harness frames 5 by means of transfer means 19, such as cables. In the embodiment shown, the upward movement is obtained by means of the harness drive mechanism 18, while the force for moving the harness frames 5 downward is provided by springs 20.

Figure 2:
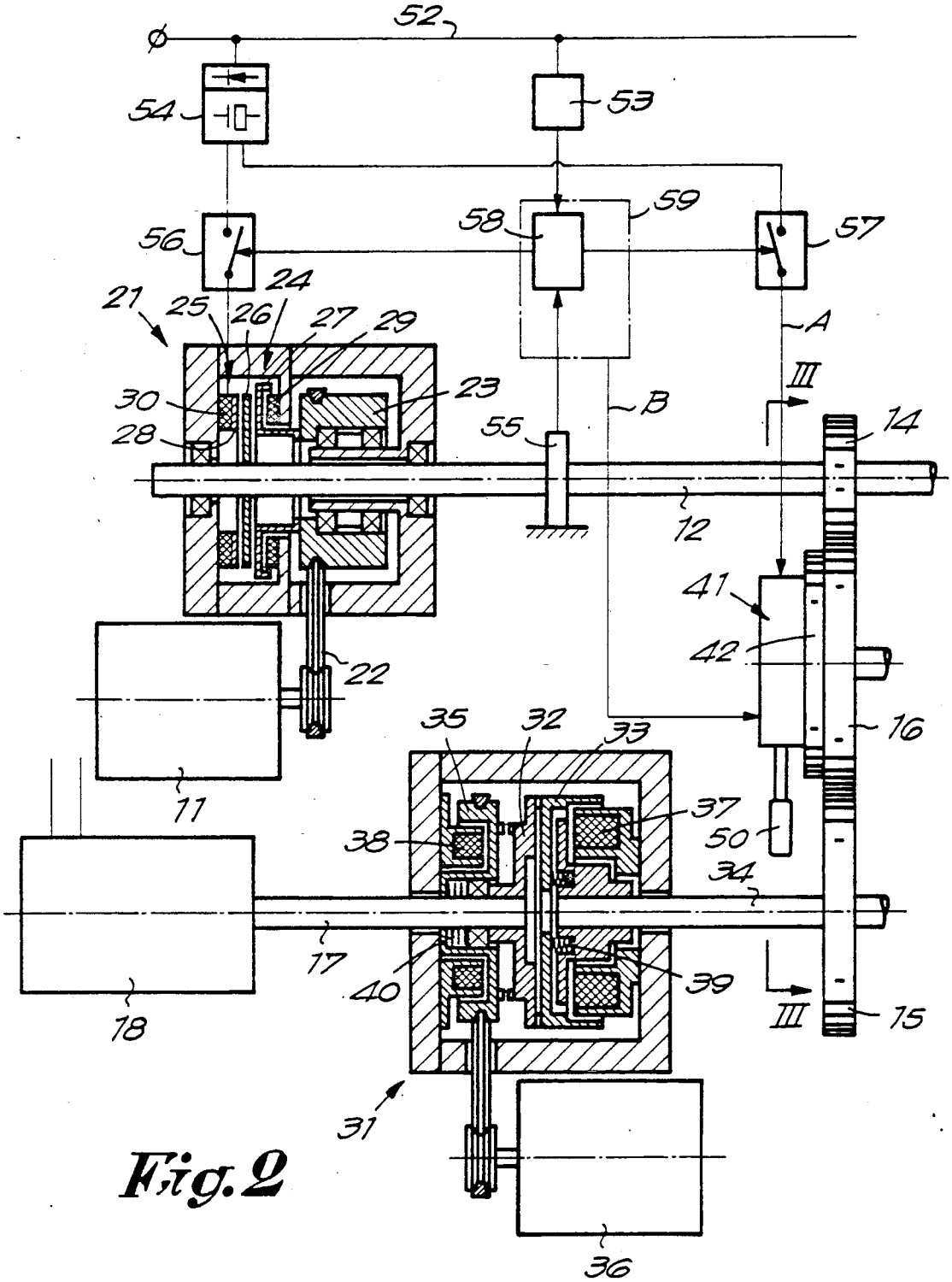
FIG. 2 shows a view of the part indicated in FIG. 1 by F2, to a greater scale and partial in cross-section.

The main drive motor 11 can be coupled to the main shaft 12 by means of a unit 21, which, as shown in FIG. 2, consists of a transfer 22, for example a belt transfer; a flywheel 23 which is driven by the transfer 22; an electromagnetic clutch 24 which allows the main shaft 12 to be coupled to the flywheel 23, and an electromagnetic brake 25 which allows to brake the main shaft 12. To this end, for example, an axially movable clutch disc 26 can be used, which is rotatable with the main shaft 12 and which on the one hand can operate in conjunction with a clutch disc 27, rotatable with the flywheel 23, and on the other hand with a fixed brake disc 28. The clutch and the brake can be energized by windings 29 and 30 respectively.

The drive shaft 17 is coupled to the gear 15 by means of a pick find clutch 31, for example of the type as described in U.S.A. Pat. No. 4,592,392 of the applicant. This pick find clutch 3 essentially consists of a central clutching part 32, fixed to the drive shaft 17; a clutching part 33 which rotates with the entering shaft 34; and a clutching part 35 which can be driven by means of a slow motion motor 36. The clutching parts 33 and 35 can be moved axially by means of electromagnets 37 and 38, as well as by springs 39 and 40, such that they can be coupled to the central clutching part 32 as desired. In a state of rest, the clutching part 33 is always coupled to the central clutching part 32 by means of the springs 39, such that in a state of rest, the main shaft 12 is also coupled to the drive shaft 17.

It is clear that the main drive motor 11, the harness drive mechanism 18, the unit 21, the pick find clutch 31 and the slow motion motor 36 are fixed, in other words they are attached to the frame of the weaving machine.

When the weaving machine stops, the clutch 24 is uncoupled and the brake 25 is activated by energizing the electromagnet 30.

It is clear that when this energization fails, the harness frames 5 are moved until a state of equilibrium is reached, determined by the springs 20.

Figure 3:
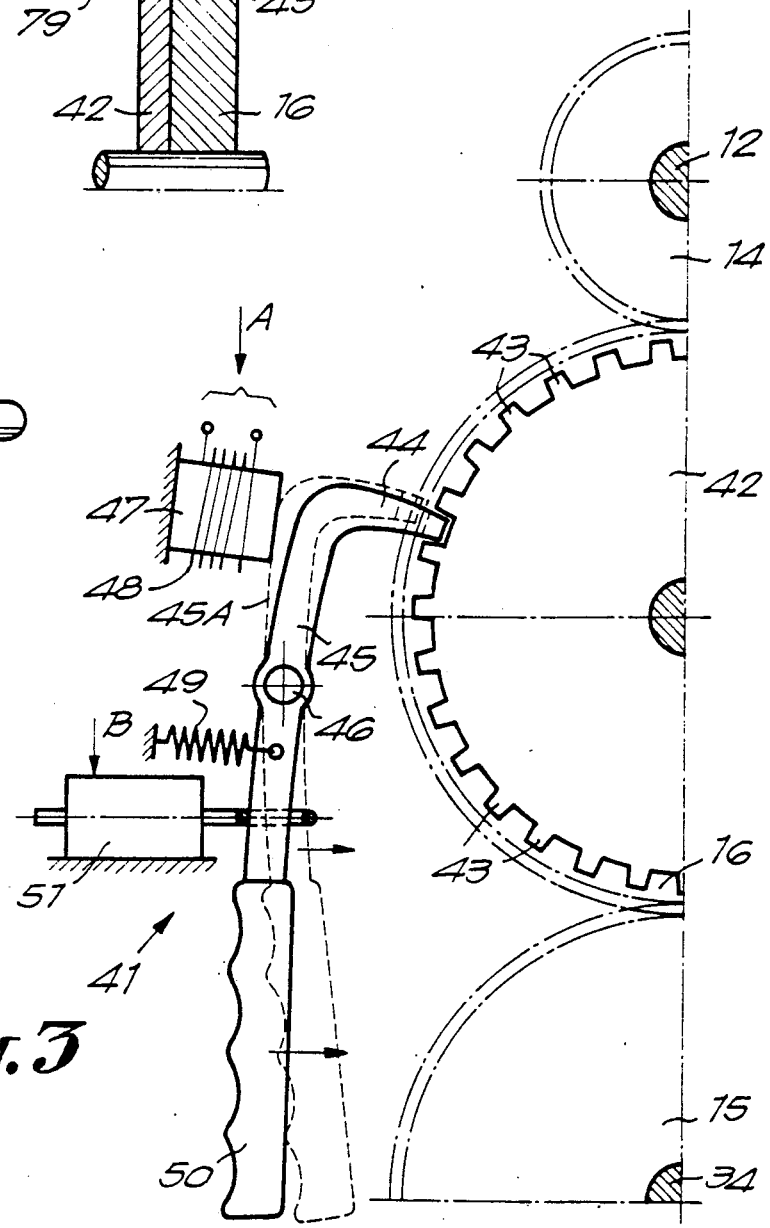
FIG. 3 shows a cross-section according to line III—III in FIG. 2.

In order to avoid this movement, the weaving machine according to the present invention is equipped with a lock 41, by means of which the main shaft !2 and also, coupled to said main shaft 12, the drive shaft 17 of the harness drive mechanism 18 can be locked against rotation. Preferably, yet not necessarily, this lock 41 is mounted on the above-mentioned intermediate gear 16, as shown in FIGS. 1 and 3. For this purpose, a wheel 42 with rectangular gear teeth 43 is applied to the intermediate gear 16, as shown in FIG. 3. Next to the wheel 42 a locking element 44 is mounted which can mesh into the gear teeth 43, which preferably makes up part of a lever 45 which is rotatable round a pivot 46.

In the unlocked position, the lever, as indicated by reference 45A, is held by a permanent magnet 47 or any other type of holding mechanism. The lock can be activated by releasing the lever 45 from the permanent magnet 47. According to FIG. 3, this is obtained by energizing a solenoid 48, which neutralizes the magnetic field of the permanent magnet 47, such that the lever 45, particularly the locking element 44, is drawn against the wheel 42 by means of a spring 49 or other elastic means, and meshes into the gear teeth 43. It is clear that other means can be used to activate the lock, or that the lock can also be activated under its own weight. Such locks have the advantage that they remain activated without any particular means, up to the moment when the lock is deactivated.

Deactivating the lock can be done in various ways. According to a first possibility, it can be done manually, for example by means of a handle 50 on the lever 45. According to another possibility, the lever 45 can be connected with a foot-operation.

According to another variant, the lock can be deactivated by activating an electromagnetic or pneumatic control mechanism 51, which acts on the bottom end of the lever 45.

According to another variant, the electromagnetic control mechanism 51, the permanent magnet 47 and the solenoid 48 can be integrated in a unit. The working is analogous as mentioned above and consists in that, in the unlocked position, the lever 45 is held by the permanent magnet 47, the lock is activated by energizing the solenoid 48, such that the latter neutralizes the magnetic field of the permanent magnet 47, resulting in the lever 45 being drawn against the wheel 42 by means of a spring 49, and the lock being deactivated by switching the polarity of the voltage at the solenoid 48, such that the magnetic field of the solenoid 48 reinforces the magnetic field of the permanent magnet 47, and the lever 45 is drawn against the permanent magnet 47 against the force of the spring 49. It is clear that in this case the necessary means must be provided to switch the polarity of the voltage at the solenoid.

As the wheel 42 exercises a certain force on the locking element 44 as a result of the present couple after the electromagnetic brake 25 has been deactivated, said locking element 44 will usually be jammed so that a great force is required to pull it loose. For the purpose of correcting this, the weaving machine can be slightly turned, either manually by the hand-operation or automatically by activating the slow motion motor 36 until the locking element 44 is released from the gear teeth 43.

In a preferred embodiment, the weaving machine also has means which automatically activate the lock 41 when the mains voltage fails, as well as means which, when the weaving machine is still working, first provide an automatic brake before the locking element 44 is activated. According to FIG. 2, all these means consist of a voltage meter 53 and capacitor supply 54, both connected to the electric mains line 52, a detector 55 for observing the rotation of the main shaft 12, switching means 56 between the capacitor supply 54 and the windings 30 of the brake 25, switching means 57 between the capacitor supply 54 and the above-mentioned solenoid 48 or similar, and a unit 58 which can make up part of the general control 59 of the weaving machine, which couples the above-mentioned parts and controls them. Of course, instead of the capacitor supply 54, any kind of separate power supply can be used.

The working can be easily deduced from the figure. When the electric voltage at the mains line 52 fails, this will be detected by the voltage meter 53. If the weaving machine is still running, this is detected by detector 55, and as a result, the unit 58 first activates the switching element 56, such that the electromagnetic brake 25 is energized from the charged capacitor supply 54. From the moment when the detector 55 no longer observes a rotation of the main shaft 12, switching element 57 is also closed, such that the solenoid 48 is energized by means of a signal A, the magnetic field of the permanent magnet 47 is neutralized and the lock 41 is activated, after which the weaver can safely work on the weaving machine.

It is clear that the lock 41 can also be deactivated automatically, for example by coupling the control mechanism 51 to the control 59, such that the control mechanism 51 can be energized automatically by means of a signal B when the weaving machine is started.

Figure 4:
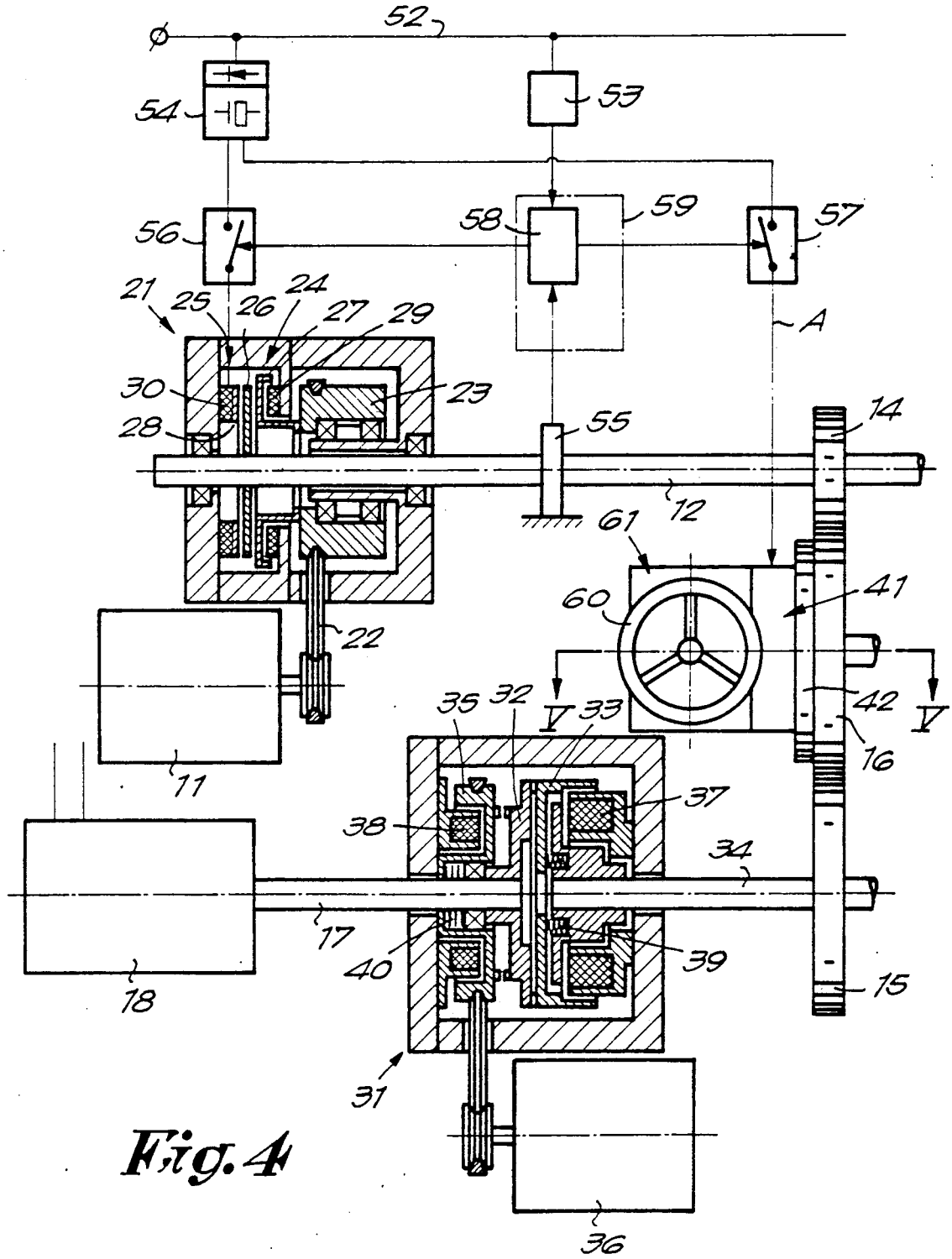
FIG. 4 shows a variant of the part presented in FIG. 2, in particular where use is made of a hand wheel.
Figure 5:
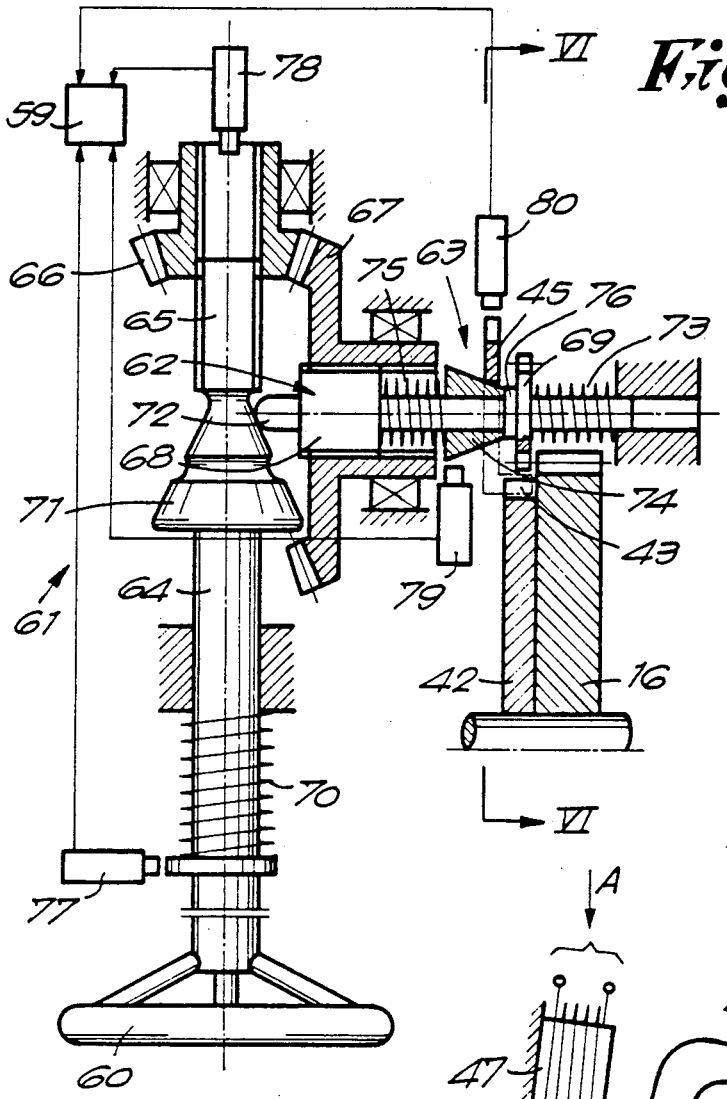
FIG. 5 shows a cross-section according to line V—V in FIG. 4.

As shown in FIG. 4, in the most preferred embodiment the hand wheel 60 of the weaving machine and the above-mentioned lock 41 can operate in conjunction with one another, whereby means 61 are provided which allow the activation and deactivation of the lock 41 by means of the hand wheel. To this end, as shown in FIG. 5, on the one hand means 62 are used for coupling and uncoupling the hand wheel 60 with the weaving machine, and on the other hand means 63 are used for breaking the lock 41, whereby these means 62 and 63 operate in conjunction with one another so that the lock 41 is automatically released when the hand wheel is activated.

The above-mentioned means are preferably made so that the hand wheel 60 can be set in three positions, as described by means of FIGS. 5 to 9.

The means 62 for coupling and uncoupling the hand wheel 60 essentially consist of a shaft 64 with a grooved end 65, which can be shifted in a conical gear 66, a second conical gear 67 operating in conjunction with it, which in turn operates in conjunction with a grooved shaft 68 shiftable inside it, a gear 69 fixed on the shaft 68 which as a result of the axial shift of the shaft 68 can mesh into a gear which is coupled to the main shaft, preferably into the above-mentioned intermediate gear 16, and a moving mechanism to move the shaft 68 when the hand wheel 60 is activated. This moving mechanism essentially ensures that the hand wheel 60 can be moved axially with the shaft 64, against the force of the spring 70, whereby a conical guide 71, connected with the shaft 64, acts on the end 72 of said shaft 68. A spring 73 ensures in this case the permanent contact between the end 72 and the conical guide 71.

Figure 6:
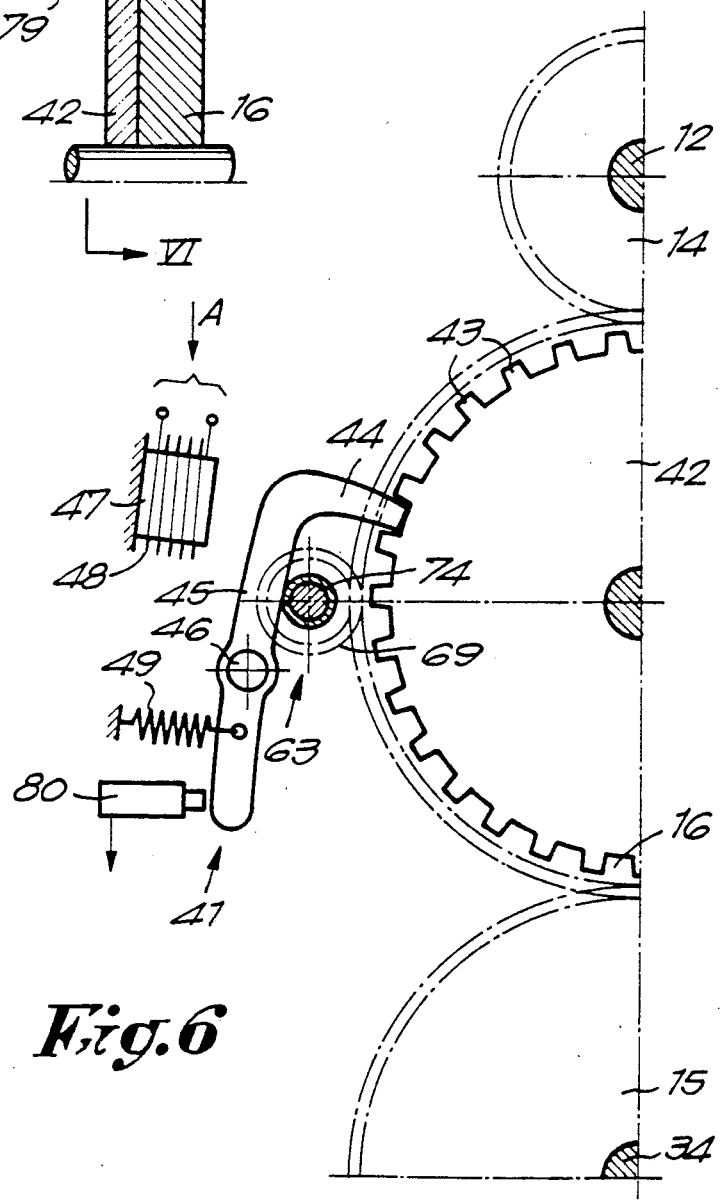
FIG. 6 shows a cross-section according to line VI—VI in FIG. 5.

The means 63 which can break the lock 41 essentially consist of a widening, preferably conical element 74, which is shiftable over the shaft 68 against the force of the compression spring 75, and whose side comes in contact with the lever 45 due to this shift, as shown in FIG. 6, such that said lever 45 can be pushed out of its locked position.

The working of this device can be easily deduced from FIGS. 5 to 9. FIGS. 5 and 6 show a position whereby the hand wheel 60 is deactivated. The conical element 74 is pushed against a stop 76 in this case.

Figure 7:
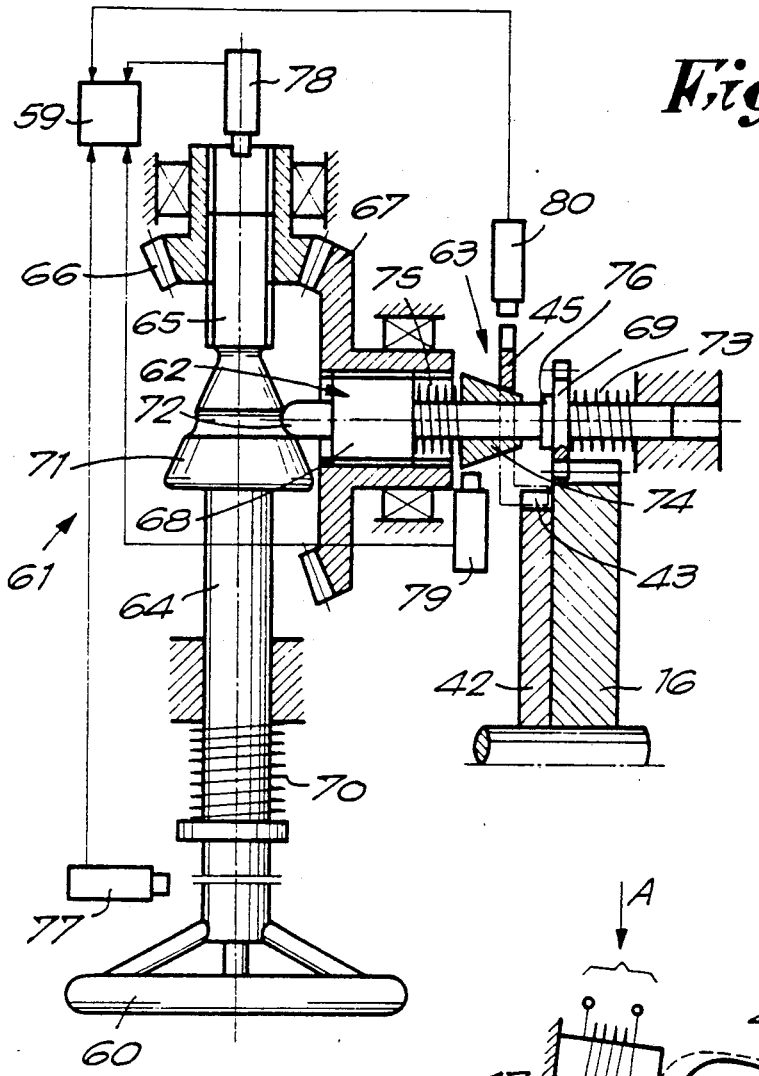
FIGS. 7 and 8 show various positions of the part presented in FIG. 5.

When using the hand wheel 60, this can be pressed into a first position, as shown in FIG. 7. Here the gear 69 meshes into the intermediate gear 16. As the locking element 44 and the wheel 42 receive the couple exercised on the weaving machine, this locking element 44 will be jammed in the wheel 42, resulting in the conical element 74 being stopped by the lever 45.

Figure 8:
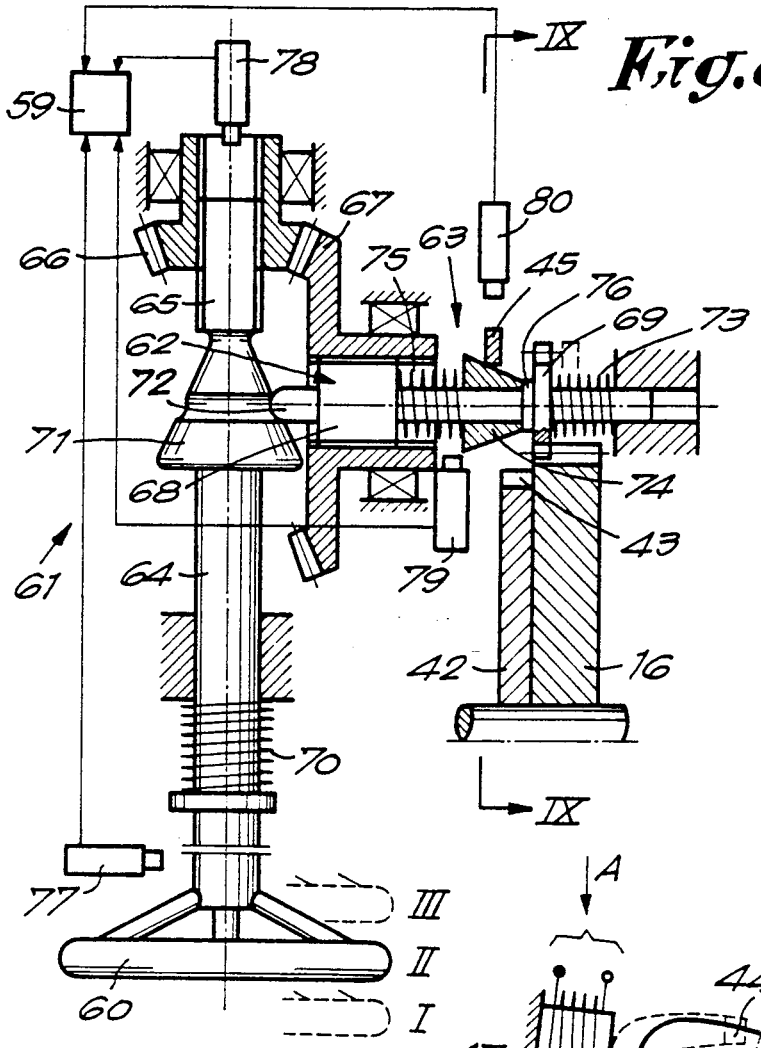
Figure 9:
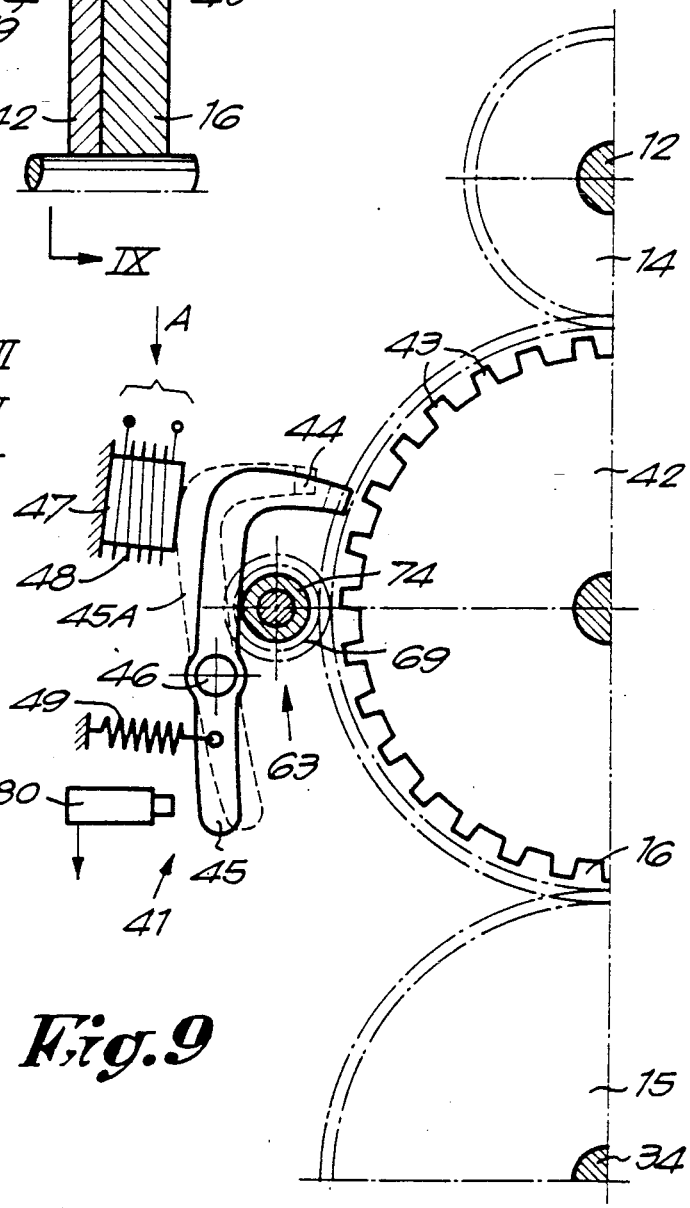
FIG. 9 shows a cross-section according to line IX—IX in FIG. 8.

From the moment when the hand wheel 60 is slightly turned and the couple is thereby received, the locking element 44 is released and the element 74 is moved by means of the spring 75, up to a position as shown in FIG. 8, particularly up to the stop 76. The lever 45 takes in this case a position as indicated by the full line in FIG. 9, whereby it is not yet attracted by the permanent magnet 47. This means that when the hand wheel is released again, the whole retakes a position as indicated in FIG. 7. However, when the hand wheel 60 is pressed further, up to position III, the lever 45 comes in contact with the permanent magnet 47, resulting in the lock 41 remaining definitely broken until the solenoid 48 is energized again.

The whole can be equipped with various detection elements, such as proximity switches 77 to 80, connected with the general control 59 in order to execute various control functions. The proximity switch 77 allows, for example, to observe the pressing of the hand wheel 60 such that when in that case the weaving machine is still running, it is automatically stopped. The proximity switch 78 observes the pressing of the shaft 64 and ensures that the electromagnetic brake 25 is uncoupled, such that the turning of the machine is made possible by means of the hand wheel 60.

The proximity switches 79 and 80 control the position of the element 74 and the lever 45 respectively.

The present invention is in no way limited to the embodiments described by way of example and shown in the drawings; on the contrary, such a weaving machine, and particularly the above-mentioned lock, can be made in various sorts of variants while still remaining within the scope of the invention.

We claim:

1. A weaving machine including a main shaft coupled to a loom motion drive shaft, and electromagnetic brake means for braking the main shaft, when activated by electric energization, said wearing machine further comprising means including a lock for locking the main shaft against rotation, said lock including a locking element having means for positively engaging gear teeth on a wheel coupled to both the main shaft and said drive shaft.

2. A weaving machine as claimed in claim 1, further comprising lever means including a lever, for activating and deactivating said locking element by rotating said lever, wherein said locking element is part of said lever.

3. A weaving machine as claimed in claim 1, further comprising means for automatically activating the lock when power to said weaving machine fails.

4. A weaving machine as claimed in claim 3, wherein said automatic activation means comprises a voltage meter; detector means for observing the rotation of the main shaft; and control means for ensuring that said locking element is only engaged with said wheel when the voltage meter does not detect any voltage and when the detector means no longer observes rotation of said main shaft, and further comprising a separate power supply which provides energization for said lock.

5. A weaving machine as claimed in claim 1, wherein said lock comprises means including a movable locking element for operation in conjunction with the main shaft to lock said main shaft; means including a permanent magnet for holding the movable locking element in an unlocking position in which the main shaft is unlocked, elastic means for biasing said locking element in the direction of a locking position in which the locking element engages said wheel and the main shaft is thereby locked, means for activating the locking element against a force of the permanent magnet such said locking element is held in its locking position by the elastic means; and means for deactivating the lock.

6. A weaving machine as claimed in claim 5, wherein said means for activating the lock comprises means including a solenoid for counteracting a magnetic field of the permanent magnet upon energization of the solenoid.

7. A weaving machine as claimed in claim 6, wherein said means for deactivating the lock includes said solenoid when the solenoid is energized such that a magnetic field of the solenoid reinforces a magnetic field of the permanent magnet.

8. A weaving machine as claimed in claim 5, wherein said means for deactivating the lock comprises means including a handle for pulling the locking element such that the locking element disengages the wheel.

9. A weaving machine as claimed in claim 5, wherein said means for deactivating the lock comprises a control mechanism, and wherein said weaving machine includes control means for activating said control mechanism to cause said deactivating means to deactivate the lock.

10. A weaving machine as claimed in claim 1, further comprising a hand wheel and lock deactivation ensuring means for ensuring that the lock can at least be deactivated upon operation of the hand wheel.

11. A weaving machine as claimed in claim 10, wherein said lock deactivating ensuring means comprises means for coupling the hand wheel to and uncoupling the hand wheel from the weaving machine, and means for breaking the lock, said coupling and uncoupling means and said lock breaking means operating in conjunction such that said lock is automatically deactivated when said hand-wheel is activated.

12. A weaving machine as claimed in claim 11, wherein said means for coupling and uncoupling said hand wheel and said means for breaking the lock by means of the operation of the hand wheel include means for setting the coupling and uncoupling means and the breaking means in three positions, and wherein in said first position said hand wheel is uncoupled from the weaving machine; in said second position, said hand wheel is coupled with the weaving machine, and said lock, if activated, is brought into position in which the lock is automatically reactivated when the hand wheel is uncoupled; and in said third position, said hand wheel is coupled to the weaving machine and the lock is brought into a deactivated position which does not allow the automatic activation of the lock when the hand wheel is deactivated.

13. A weaving machine as claimed in claim 11, wherein said hand wheel is axially movable and aid means for coupling and uncoupling said hand wheel comprises a gear rotatable with the hand wheel, and means for causing, in response to the axial movement of the hand wheel, said hand wheel to engage a gear which is coupled to the main shaft of the weaving machine.

14. A weaving machine as claimed in claim 13, wherein said means for breaking the lock comprises means including a movable element for shifting with the axial movement of the hand wheel in order to push the locking element from its locking position.

15. A weaving machine as claimed in claim 14, wherein said movable element comprises a conical element, and further comprising means for shifting the conical element over an axially movable shaft by means of said hand wheel such that said conical element is caused to be forced forward by means of a spring such that the locking element is released only when it can move freely.

16. A weaving machine as claimed in claim 15, wherein the axially movable shaft includes means including a stop for limiting the movement of the conical element such that the conical element cannot operate in conjunction with the locking element when said hand wheel is in said first position.

17. A weaving machine as claimed in claim 16, wherein the lock comprises means including a holding mechanism for holding the locking element in its unlocked position and for positioning the stop on the shaft such that when the hand wheel is moved to a position where it is just coupled to the weaving machine, the element is permitted to take an extreme position whereby the lock is deactivated and the locking element does not contact the holding mechanism, and when the hand wheel is in a further position, the stop ensures that the conical element brings the locking element into contact with the holding mechanism.

* * * * *